United States Patent [19]

Broze et al.

[11] 4,443,352

[45] Apr. 17, 1984

[54] SILICATE-FREE BLEACHING AND LAUNDERING COMPOSITION

[75] Inventors: Guy Broze, Grace-Hollogne; Leopold Laitem, Orp-le-Grand, both of Belgium

[73] Assignee: Colgate-Palmolive Company, New York, N.Y.

[21] Appl. No.: 354,860

[22] Filed: Mar. 4, 1982

[51] Int. Cl.[3] ..... C11D 3/395

[52] U.S. Cl. ..... 252/94; 252/95; 252/97; 252/102; 252/99; 252/135; 252/525; 252/527; 252/558; 252/186.1; 252/186.31; 252/186.42; 252/186.43

[58] Field of Search ..... 252/99, 94, 95, 97, 252/102, 135, 558, 525, 527, 186.1, 186.31, 186.42, 186.43

[56] References Cited

U.S. PATENT DOCUMENTS

| | | | |
|---|---|---|---|
| 3,637,339 | 1/1972 | Gray | 252/99 |
| 3,822,114 | 7/1974 | Montgomery | 252/99 |
| 3,860,391 | 1/1975 | Kling et al. . | |
| 4,128,495 | 12/1978 | McCrudden | 252/95 |
| 4,294,575 | 10/1981 | Kowalski . | |
| 4,347,149 | 8/1982 | Smith et al. | 252/102 |

FOREIGN PATENT DOCUMENTS

| | | |
|---|---|---|
| 28432 | 10/1980 | European Pat. Off. . |
| 27693 | 4/1981 | European Pat. Off. . |

*Primary Examiner*—John E. Kittle
*Assistant Examiner*—Hoa Van Le
*Attorney, Agent, or Firm*—Bernard Lieberman; Herbert S. Sylvester; Murray M. Grill

[57] ABSTRACT

An improved granular bleaching detergent composition is provided comprising (a) a bleaching agent comprising a peroxyacid compound and/or a water-soluble salt thereof; and (b) at least one surface active agent selected from the group consisting of anionic, cationic, nonionic, ampholytic and zwitterionic detergents; said bleaching detergent composition being substantially free of silicate compounds.

9 Claims, No Drawings

SILICATE-FREE BLEACHING AND LAUNDERING COMPOSITION

CROSS REFERENCE TO RELATED APPLICATION

This application is related to copending U.S. application Ser. No. 354,861, filed on even date herewith, which describes a granular bleaching detergent composition which is substantially-free of silicate compounds and comprises a peroxygen compound in combination with an activator therefor and at least one surface active detergent compound.

BACKGROUND OF THE INVENTION

The present invention relates, in general, to bleaching detergent compositions containing as a bleaching agent a peroxyacid compound, and the application of such compositions to laundering operations. More particularly, the present invention relates to granular bleaching detergent compositions which provide enhanced bleaching performance concomitant with a significant improvement in the stability of the peroxyacid bleaching species in the wash solution.

Bleaching compositions which release active oxygen in the wash solution are extensively described in the prior art and commonly used in laundering operations. In general, such bleaching compositions contain peroxygen compounds, such as, perborates, percarbonates, perphosphates and the like which promote the bleaching activity by forming hydrogen peroxide in aqueous solution. A major drawback attendant to the use of such peroxygen compounds is that they are not optimally effective at the relatively low washing temperatures employed in most household washing machines in the United States, i.e., temperatures in the range of 80° to 130° F. By way of comparison, European wash temperatures are generally substantially higher extending over a range, typically, from 90° to 200° F. However, even in Europe and those other countries which generally presently employ near boiling washing temperatures, there is a trend towards lower temperature laundering.

In an effort to enhance the bleaching activity of peroxygen bleaches, the prior art has employed materials called activators in combination with the peroxygen compounds. It is generally believed that the interaction of the peroxygen compound and the activator results in the formation of a peroxyacid which is a more active bleaching species than hydrogen peroxide at lower temperatures. Numerous compounds have been proposed in the art as activators for peroxygen bleaches among which are included carboxylic acid anhydrides such as those disclosed in U.S. Pat. Nos. 3,298,775; 3,338,839; and 3,532,634; carboxylic esters such as those disclosed in U.S. Pat. No. 2,995,905; N-acyl compounds such as those described in U.S. Pat. Nos. 3,912,648 and 3,919,102; cyanoamines such as described in U.S. Pat. No. 4,199,466; and acyl sulfoamides such as disclosed in U.S. Pat. No. 3,245,913.

The formation and stability of the peroxyacid bleaching species in bleach systems containing a peroxygen compound and an organic activator has been recognized as a problem in the prior art. U.S. Pat. No. 4,255,452 to Leigh, for example, specifically addresses itself to the problem of avoiding the reaction of peroxyacid with peroxygen compound to form what the patent characterizes as "useless products, viz. the corresponding carboxylic acid, molecular oxygen and water". The patent states that such side-reaction is "doubly deleterious since peracid and percompound . . . are destroyed simultaneously." The patentee thereafter describes certain polyphosphonic acid compounds as chelating agents which are said to inhibit the above-described peroxyacid-consuming side reaction and provide an improved bleaching effect. In contrast with the use of these chelating agents, the patentee states that other more commonly known chelating agents, such as, ethylene diamine tetraacetic acid (EDTA) and nitrilotriacetic acid (NTA) are substantially ineffective and do not provide improved bleaching effects. Accordingly, a disadvantage of the bleaching compositions of the Leigh patent is that they necessarily preclude the use of conventional sequestrants, many of which are less expensive and more readily available than the disclosed polyphosphonic acid compounds.

The influence of silicates on the decomposition of peroxyacid in the wash and/or bleaching solution has heretofore gone unrecognized in the art. U.S. Pat. Nos. 3,860,391 and 4,292,575 disclose that silicates are conventionally employed as additives to peroxide-containing bleaching solutions for the purpose of stabilizing peroxide compounds therein. However, the patentees note the fact that the use of silicates in such bleaching solutions may create other problems in the bleaching operations, such as, the formation of silicate precipitates which deposit on the bleached goods. Consequently, the patents are directed to processes for bleaching cellulose fiber with silicate-free bleaching solutions in whch peroxide stability is enhanced with compounds other than silicates.

European Patent Publication No. 28,432, published May 13, 1981, describes on page 7 thereof certain polyphosphonate compounds which "have been found to be uniquely effective in stabilizing organic peroxyacids against the generally deleterious effect of water-insoluble silicates, especially those belonging to the zeolite and kaolin classes". The nature of such "deleterious effect" is not specified. A preferred embodiment of the invention is said to be a granular detergent composition comprising the defined polyphosphonate compound in combination with a water-insoluble silicate and an "organic peroxyacid bleach percursor", more commonly known an as organic activator. Thus, the art has heretofore failed to appreciate or suggest the improved bleaching performance which can be achieved with granular bleaching detergent compositions containing a peroxyacid compound when such compositions are characterized by the absence of silicate compounds of the type conventionally used in detergent compositions.

SUMMARY OF THE INVENTION

The present invention provides a granular bleaching detergent composition comprising: (a) a bleaching agent comprising a peroxyacid compound and/or a water-soluble salt thereof; and (b) at least one surface active agent selected from the group of anionic, cationic, nonionic, ampholytic and zwitterionic detergents; said bleaching detergent composition being substantially free of silicate compounds.

In accordance with the process of the invention, bleaching of stained and/or soiled materials is effected by contacting such materials with an aqueous solution of the above-defined bleaching detergent composition.

The present invention is predicated on the discovery that the undesired loss of peroxyacid in the aqueous wash solution by the reaction of peroxyacid with hydrogen peroxide (derived from the decomposition of the peroxyacid compound or alternatively, from a peroxygen compound, if present in solution) to form molecular oxygen is significantly minimized in bleaching systems which are substantially free of silicate compounds. Although the applicants do not wish to be bound to any particular theory of operation, it is believed that the presence of silicates in bleaching systems containing a peroxyacid compound catalyzes the aforementioned reaction of peroxyacid with hydrogen peroxide which results in the loss of active oxygen from the wash solution which would otherwise be available for bleaching. It has been recognized in the art that metal ions, such as, for example, ions of iron and copper serve to catalyze the decomposition of hydrogen peroxide and also the peroxyacid reaction with hydrogen peroxide. However, with regard to such metal ion catalysis, the applicants have surprisingly discovered that conventional sequestrants, such as, EDTA or NTA, which the prior art has deemed to be ineffective for inhibiting the aforementioned peroxyacid-consuming reaction (see, for example, the statement in column 4 of U.S. Pat. No. 4,225,452) can be incorporated into the compositions of the present invention to stabilize the peroxyacid in solution.

The term "silicate compounds" as used throughout the specification and claims is intended to encompass water-soluble as well as water-insoluble compounds containing $SiO_2$. Sodium silicate is illustrative of a water-soluble silicate compound which is commonly present in conventional bleaching detergent compositions but is substantially eliminated in the compositions of the present invention; alumino-silicate materials such as clays and zeolites are illustrative of the water-insoluble compounds which are to be substantially eliminated in the compositions described herein. Water-soluble silicate compounds are generally considered more detrimental to peroxyacid stability than water-insoluble materials such as aluminosilicates, the former being more active catalysts in the wash solution for the above-described peroxyacid reaction with hydrogen peroxide.

DETAILED DESCRIPTION OF THE INVENTION

The bleaching detergent compositions of the invention are substantially free of silicate compounds and are comprised of two essential components: (a) a bleaching agent; and (b) a detergent surface active agent.

The bleaching agent useful in such compositions comprises a water-soluble peroxyacid compound and/or a water-soluble salt thereof. Peroxyacid compounds are characterized by the following general formula:

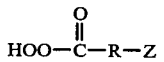

wherein R is an alkyl or alkylene group containing from 1 to about 20 carbon atoms, or a phenylene group, and Z is one or more groups selected from among hydrogen, halogen, alkyl, aryl and anionic groups.

The organic peroxyacids and the salts thereof can contain from about 1 to about 4, preferably 1 or 2, peroxy groups and can be aliphatic or aromatic. The preferred aliphatic peroxyacids include diperoxyazelaic acid diperoxydodecanedioic acid and, monoperoxysuccinic acid. Among the aromatic peroxyacid compounds useful herein, monoperoxyphthalic acid (MPPA), particularly the magnesium salt thereof, and diperoxyterephthalic acid are especially preferred. A detailed description of the production of MPPA and its magnesium salt is set forth on pages 7–10, inclusive, of European Patent Publication No. 27,693, published Apr. 29, 1981, the aforementioned pages 7–10 being incorporated herein by reference.

The bleaching agent may optionally also include a peroxygen compound in addition to the peroxyacid compound. The useful peroxygen compounds include compounds that release hydrogen peroxide in aqueous media, such as, alkali metal perborates, e.g., sodium perborate and potassium perborate, alkali metal perphosphates and alkali metal percarbonates. The alkali metal perborates are usually preferred because of their commercial availability and relatively low cost. If desired, an organic activator may be used in conjunction with such peroxygen compound. Conventional activators such as those disclosed, for example, at column 4 of U.S. Pat. No. 4,259,200 are suitable for use in the present compositions, such disclosure being incorporated herein by reference. The polyacylated amines are generally of special interest, tetraacetyl ethylene diamine (TAED) in particular being a highly preferred activator. The molar ratio of peroxygen compound to activator can vary widely depending upon the particular choice of peroxygen compound and activator. However, molar ratios of from about 0.5:1 to about 25:1 are generally suitable for providing satisfactory bleaching performance.

In a preferred embodiment of the invention, the bleaching compositions described herein additionally contain a sequestering agent to enhance the stability of the peroxyacid bleaching compound in solution by inhibiting its reaction with hydrogen peroxide in the presence of metal ions. The term "sequestering agent" as used herein refers to organic compounds which are able to form a complex with $Cu^{2+}$ ions, such that the stability constant (pK) of the complexation is equal to or greater than 6, at 25° C., in water at an ionic strength of 0.1 mole/liter; pK being conventionally defined by the formula: $pK = -\log K$ where K represents the equilibrium constant. Thus, for example, the pK values for complexation of copper ion with NTA and EDTA at the stated conditions are 12.7 and 18.8, respectively. The sequestering agents employed herein thus exclude inorganic compounds ordinarily used in detergent formulations as builder salts. Accordingly, suitable sequestering agents include the sodium salts of nitrilotriacetic acid (NTA); ethylene diamine tetraacetic acid (EDTA); diethylene triamine pentaacetic acid (DETPA); diethylene triamine pentamethylene phosphonic acid (DTPMP); and ethylene diamine tetramethylene phosphonic acid (EDITEMPA). EDTA is especially preferred for use in the present compositions.

The compositions of the present invention contain one or more surface active agents selected from the group of anionic, nonionic, cationic, ampholytic and zwitterionic detergents.

Among the anionic surface active agents useful in the present invention are those surface active compounds which contain an organic hydrophobic group containing from 8 to 26 carbon atoms and preferably from about 10 to 18 carbon atoms in their molecular structure and at least one water-solubilizing group selected from the group of sulfonate, sulfate, carboxylate, phosphonate and phosphate so as to form a water-soluble detergent.

Examples of suitable anionic detergents include soaps, such as, the water-soluble salts (e.g., the sodium potassium, ammonium and alkanolammonium salts) of higher fatty acids or resin salts containing from about 8 to 20 carbon atoms and preferably 10 to 18 carbon atoms. Suitable fatty acids can be obtained from oils and waxes of animal or vegetable origin, for example, tallow, grease, coconut oil and mixtures thereof. Particularly useful are the sodium and potassium salts of the fatty acid mixtures derived from coconut oil and tallow, for example, sodium coconut soap and potassium tallow soap.

The anionic class of detergents also includes the water-soluble sulfated and sulfonated detergents having an alkyl radical containing from about 8 to 26, and preferably from about 12 to 22 carbon atoms. (The term "alkyl" includes the alkyl portion of the higher acyl radicals). Examples of the sulfonated anionic detergents are the higher alkyl mononuclear aromatic sulfonates such as the higher alkyl benzene sulfonates containing from about 10 to 16 carbon atoms in the higher alkyl group in a straight or branched chain, such as, for example, the sodium, potassium and ammonium salts of higher alkyl benzene sulfonates, higher alkyl toluene sulfonates and higher alkyl phenol sulfonates.

Other suitable anionic detergents are the olefin sulfonates including long chain alkene sulfonates, long chain hydroxyalkane sulfonates or mixtures of alkene sulfonates and hydroxyalkane sulfonates. The olefin sulfonate detergents may be prepared in a conventional manner by the reaction of $SO_3$ with long chain olefins containing from about 8 to 25, and preferably from about 12 to 21 carbon atoms, such olefins having the formula $RCH{=}CHR_1$ wherein R is a higher alkyl group of from about 6 to 23 carbons and $R_1$ is an alkyl group containing from about 1 to 17 carbon atoms, or hydrogen to form a mixture of sultones and alkene sulfonic acids which is then treated to convert the sultones to sulfonates. Other examples of sulfate or sulfonate detergents are paraffin sulfonates containing from about 10 to 20 carbon atoms, and preferably from about 15 to 20 carbon atoms. The primary paraffin sulfonates are made by reacting long chain alpha olefins and bisulfites. Paraffin sulfonates having the sulfonate group distributed along the paraffin chain are shown in U.S. Pat. Nos. 2,503,380; 2,507,088; 3,260,741; 3,372,188 and German Patent No. 735,096. Other useful sulfate and sulfonate detergents include sodium and potassium sulfates of higher alcohols containing from about 8 to 18 carbon atoms, such as, for example, sodium lauryl sulfate and sodium tallow alcohol sulfate, sodium and potassium salts of alpha-sulfofatty acid esters containing about 10 to 20 carbon atoms in the acyl group, for example, methyl alpha-sulfomyristate and methyl alpha-sulfotallowate, ammonium sulfates of mono- or di- glycerides of higher ($C_{10}$–$C_{18}$) fatty acids, for example, stearic monogylceride monosulfate; sodium and alkylol ammonium salts of alkyl polyethenoxy ether sulfates produced by condensing 1 to 5 moles of ethylene oxide with 1 mole of higher ($C_8$–$C_{18}$) alcohol; sodium higher alkyl ($C_{10}$–$C_{18}$) glyceryl ether sulfonates; and sodium or potassium alkyl phenol polyethenoxy ether sulfates with about 1 to 6 oxyethylene groups per molecule and in which the alkyl radicals contain about 8 to 12 atoms.

The most highly preferred water-soluble anionic detergent compounds are the ammonium and substituted ammonium (such as mono, di and tri-ethanolamine), alkali metal (such as sodium and potassium) and alkaline earth metal (such as, calcium and magnesium) salts of the higher alkyl benzene sulfonates, olefin sulfonates and higher alkyl sulfates. Among the above-listed anionics, the most preferred are the sodium linear alkyl benzene sulfonates (LABS).

The nonionic synthetic organic detergents are characterized by the presence of an organic hydrophobic group and an organic hydrophilic group and are typically produced by the condensation of an organic alphatic or alkyl aromatic hydrophobic compound with ethylene oxide (hydrophilic in nature). Practically any hydrophobic compound having a carboxy, hydroxy, amido or amino group with a free hydrogen attached to the nitrogen can be condensed with ethylene oxide or with the polyhydration product thereof, polyethylene glycol, to form a nonionic detergent. The length of the hydrophilic or polyoxyethylene chain can be readily adjusted to achieve the desired balance between the hydrophobic and hydrophilic groups.

The nonionic detergents include the polyethylene oxide condensate of 1 mole of alkyl phenol containing from about 6 to 12 carbon atoms in a straight or branched chain configuration with about 5 to 30 moles of ethylene oxide. Examples of the aforementioned condensates include nonyl phenol condensed with 9 moles of ethylene oxide; dodecyl phenol condensed with 15 moles of ethylene oxide; and dinonyl phenol condensed with 15 moles of ethylene oxide. Condensation products of the corresponding alkyl thiophenols with 5 to 30 moles of ethylene oxide are also suitable.

Of the above-described types of nonionic surfactants, those of the ethoxylated alcohol type are preferred. Particularly preferred nonionic surfactants include the condensation product of coconut fatty alcohol with about 6 moles of ethylene oxide per mole of coconut fatty alcohol, the condensation product of tallow fatty alcohol with about 11 moles of ethylene oxide per mole of tallow fatty alcohol, the condensation product of a secondary fatty alcohol containing about 11–15 carbon atoms with about 9 moles of ethylene oxide per mole of fatty alcohol and condensation products of more or less branched primary alcohols, whose branching is predominantly 2-methyl, with from about 4 to 12 moles of ethylene oxide.

Zwitterionic detergents such as the betaines and sulfobetaines having the following formula are also useful:

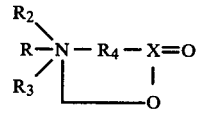

wherein R is an alkyl group containing from about 8 to 18 carbon atoms, $R_2$ and $R_3$ are each an alkylene or hydroxyalkylene group containing about 1 to 4 carbon atoms, $R_4$ is an alkylene or hydroxyalkylene group containing 1 to 4 carbon atoms, and X is C or S:O. The alkyl group can contain one or more intermediate linkages such as amido, ether, or polyether linkages or nonfunctional substituents such as hydroxyl or halogen which do not substantially affect the hydrophobic character of the group. When X is C, the detergent is called a betaine; and when X is S:O, the detergent is called a sulfobetaine or sultaine.

Cationic surface active agents may also be employed. They comprise surface active detergent compounds which contain an organic hydrophobic group which forms part of a cation when the compound is dissolved in water, and an anionic group. Typical cationic surface active agents are amine and quaternary ammonium compounds.

Examples of suitable synthetic cationic detergents include: normal primary amines of the formula $RNH_2$ wherein R is an alkyl group containing from about 12 to 15 atoms; diamines having the formula $RNHC_2H_4NH_2$ wherein R is an alkyl group containing from about 12 to 22 carbon atoms, such as N-2-aminoethyl-stearyl amine and N-2-aminoethyl myristyl amine; amide-linked amines such as those having the formula $R_1CONHC_2H_4NH_2$ wherein $R_1$ is an alkyl group containing about 8 to 20 carbon atoms, such as N-2-amino ethylstearyl amide and N-amino ethylmyristyl amide; quaternary ammonium compounds wherein typically one of the groups linked to the nitrogen atom is an alkyl group containing about 8 to 22 carbon atoms and three of the groups linked to the nitrogen atom are alkyl groups which contain 1 to 3 carbon atoms, including alkyl groups bearing inert substituents, such as phenyl groups, and there is present an anion such as halogen, acetate, methosulfate, etc. The alkyl group may contain intermediate linkages such as amide which do not substantially affect the hydrophobic character of the group, for example, stearyl amido propyl quaternary ammonium chloride. Typical quaternary ammonium detergents are ethyl-dimethyl-stearyl-ammonium chloride, benzyl-dimethyl-stearyl ammonium chloride, trimethyl-stearyl ammonium chloride, trimethyl-cetyl ammonium bromide, dimethylethyl-lauryl ammonium chloride, dimethyl-propyl-myristl ammonium chloride, and the corresponding methosulfates and acetates.

Ampholytic detergents are also suitable for the invention. Ampholytic detergents are well known in the art and many operable detergents of this class are disclosed by A. M. Schwartz, J. W. Perry and J. Birch in "Surface Active Agents and Detergents", Interscience Publishers, New York, 1958, vol. 2. Examples of suitable amphoteric detergents include: alkyl betaiminodipropionates, $RN(C_2H_4COOM)_2$; alkyl beta-amino propionates, $RN(H)C_2H_4COOM$; and long chain imidazole derivatives having the general formula:

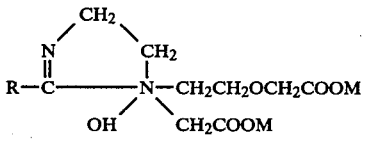

wherein in each of the above formulae R is an acyclic hydrophobic group containing from about 8 to 18 carbon atoms and M is a cation to neutralize the charge of the anion. Specific operable amphoteric detergents include the disodium salt of undecylcycloimidiniumethoxyethionic acid-2-ethionic acid, dodecyl beta alanine, and the inner salt of 2-trimethylamino lauric acid.

The bleaching detergent compositions of the invention optionally contain a detergent builder of the type commonly used in detergent formulations. Useful builders include any of the conventional inorganic water-soluble builder salts, such as, for example, water-soluble salts of phosphates, pyrophosphates, orthophosphates, polyphosphates, carbonates and the like. Organic builders include water-soluble phosphonates, polyphosphonates, polyhydroxysulfonates, polyacetates, carboxylates, polycarboxylates, succinates and the like.

Specific examples of inorganic phosphate builders include sodium and potassium tripolyphosphates, pyrophosphates and hexametaphosphates. The organic polyphosphonates specifically include, for example, the sodium and potassium salts of ethane 1-hydroxy-1, 1-disphosphonic acid and the sodium and potassium salts of ethane-1, 1, 2-triphosphonic acid. Examples of these and other phosphorous builder compounds are disclosed in U.S. Pat. Nos. 3,213,030; 3,422,021; 3,422,137 and 3,400,176. Pentasodium tripolyphosphate and tetrasodium pyrophosphate are especially preferred water-soluble inorganic builders.

Specific examples of non-phosphorous inorganic builders include water-soluble inorganic carbonate and bicarbonate salts. The alkali metal, for example, sodium and potassium, carbonates and bicarbonates are particularly useful herein.

Water-soluble organic builders are also useful. For example, the alkali metal, ammonium and substituted ammonium polyacetates, carboxylates, polycarboxylates and polyhydroxysulfonates are useful builders for the compositions and processes of the invention. Specific examples of polyacetate and polycarboxylate builders include, sodium, potassium, lithium, ammonium and substituted ammonium salts of ethylene diaminetetracetic acid, nitrilotriacetic acid, benzene polycarboxylic (i.e. penta- and tetra-) acids, carboxymethoxysuccinic acid and citric acid.

The use of inert, water-soluble filler salts is desirable in the compositions of the invention. A preferred filler salt is an alkali metal sulfate, such as, potassium or sodium sulfate, the latter being especially preferred.

Various adjuvants may be included in the bleaching detergent compositions of the invention. For example, colorants, e.g., pigments and dyes, antiredeposition agents, such as, carboxymethylcellulose, optical brighteners, such as, anionic, cationic and nonionic brighteners; foam stabilizers, such as, alkanolamides, proteolytic enzymes and the like are all well-known in the fabric washing art for use in detergent compositions.

A preferred composition in accordance with the invention typically comprises (a) from about 2 to 50%, by weight, of a bleaching agent comprising a peroxyacid compound and/or a water-soluble salt thereof, a concentration of from about 3 to about 25%, by weight, being particularly preferred; (b) from about 5 to 50%, by weight, of a detergent surface active agent; (c) from about 1 to about 60%, by weight, of a detergent builder salt; and (d) from about 0.1 to about 10%, by weight, of a sequestering agent. The balance of the composition will predominantly comprise water, filler salts, such as, sodium sulfate, and minor additives selected from among the various adjuvants described above.

The granular bleaching detergent compositions of the invention are prepared by admixing the bleaching agent and optional sequestering agent with the spray-dried detergent composition, the latter being formulated so as to avoid the use of silicate compounds, such as, for example, sodium silicate, clays and/or zeolites. The presence of very minor amounts of silicate compounds in the final compositions, i.e., below about 0.1%, preferably below about 0.01%, and most preferably no greater than about 0.005%, by weight, such as may occur with the use of silicate-containing pigments or dyes is contemplated by the present invention.

The spry drying of a silicate-free detergent formulation may result in a relatively dusty granular product due to the absence of silicate as a binder for the spray dried beads. However, alternative organic binder materials may be employed, such as, for example, starch, carboxymethylcellulose and materials comparable thereto. The strength of the spray dried bends may also be enhanced by maximizing the solids content of the silicate-free slurry in the crutcher and/or by maintaining the inlet temperature of the hot air stream in the spray tower as low as possible.

The bleaching agent can be mixed either directly with the spray dried powder or the bleaching agent and optional sequestering agent can be separately or collectively coated with coating material to prevent premature activation of the bleaching agent. The coating process is conducted in accordance with procedures well known in the art. Suitable coating materials include compounds such as magnesium sulfate, polyvinyl alcohol, lauric acid and its salts and the like.

The bleaching detergent compositions of the invention are added to the wash solution in an amount sufficient to provide from about 3 to about 100 parts of active oxygen per million parts of solution, a concentration of from about 5 to about 40 ppm being generally preferred.

The term "granular" as used herein with regard to the above-described bleaching detergent compositions refers to particulate compositions produced by spray-drying methods of manufacture as well as by methods of dry-bleaching or agglomeration of the individual components.

EXAMPLE 1

A preferred silicate-free bleaching detergent composition is comprised of the following:

| Component | Weight Percent |
|---|---|
| Sodium linear $C_{10}$–$C_{13}$ alkyl benzene sulfonate | 6 |
| Ethoxylated $C_{11}$–$C_{18}$ primary alcohol (11 moles EO per mole alcohol) | 3 |
| Soap (sodium salt of $C_{12}$–$C_{22}$ carboxylic acid) | 4 |
| Pentasodium tripolyphosphate (TPP) | 35.0 |
| EDTA (disodium salt) | 0.7 |
| Carboxymethyl cellulose | 0.5 |
| Monoperoxyphthalic acid (magnesium salt: MPPA) | 6 |
| Optical brighteners, pigment and perfume | 0.4 |
| Proteolytic Enzyme | 0.5 |
| Sodium sulfate and water | balance |

The foregoing product is produced by spray drying an aqueous slurry containing 60%, by weight, of a mixture containing all of the above components except the enzyme, perfume and sodium perborate. The resultant granular spray dried product has a particle size in the range of 14 mesh to 270 mesh, (U.S. Sieve Series). The spray dried product is then mixed in a rotary drum with the appropriate amounts of sodium perborate of similar mesh size, enzyme and perfume to yield a particulate product of the foregoing composition having a moisture of approximately 18%, by weight.

The above-described product is used to wash soiled fabrics by hand-washing as well as in a washing machine, and good laundering and bleaching performance is obtained for both methods of laundering.

Other satisfactory products can be obtained by varying the concentrations of the following principal components in the above described composition as follows:

| Component | Weight Percent. |
|---|---|
| Alkyl benzene sulfonate | 4–12 |
| Ethoxylated alcohol | 1–6 |
| Soap | 1–10 |
| TPP | 15–50 |
| Enzymes | 0.1–1 |
| EDTA | 0.1–2 |
| TAED | 1–10 |
| Sodium perborate | 5–20 |

EXAMPLE 2

Bleaching tests are carried out as described below comparing at various time intervals the active oxygen concentration in solution provided by a silicate-free bleaching detergent composition in accordance with the invention and a silicate-containing composition, the latter composition being comparable to the former in nearly all respects except for the presence of sodium silicate. The bleaching agent employed is a mixture of a monoperoxyphthalic acid salt and sodium perborate. The compositions are formulated by post-adding to a spray-dried granular detergent composition, granules of the H-48 bleaching composition (described in the footnote of Table 1) and sodium perborate tetrahydrate to form the bleaching detergent compositions A and B shown in Table 1 below. The numbers indicated in the Table represent the percentage of each component, by weight, in the composition.

TABLE 1

| Component | Composition A (Silicate-free) | Composition B (Silicate-containing) |
|---|---|---|
| Sodium linear $C_{10}$–$C_{13}$ alkyl benzene sulfonate | 6.00% | 6.00% |
| Ethoxylated $C_{11}$–$C_{18}$ primary alcohol (11 moles EO per mole alcohol) | 3.50 | 3.50 |
| Soap (Sodium salt of $C_{12}$–$C_{22}$ carboxylic acid) | 2.50 | 2.50 |
| Sodium silicate ($Na_2O:2SiO_2$) | — | 9.00 |
| Pentasodium tripolyphosphate (TPP) | 35.00 | 35.00 |
| Optical brightener (stilbene) | 0.22 | 0.22 |
| Sodium perborate tetrahydrate | 3.00 | 3.00 |
| H-48(1) | 9.00 | 9.00 |
| EDTA (Disodium salt) | 1.00 | 1.00 |
| Sodium sulfate | 35.00 | 10.60 |
| Water | balance | balance |

(1)A bleaching composition sold by Interox Chemicals Limited, London, England, containing about 65 wt. % magnesium monoperoxyphthalate, 11 wt. % magnesium phthalate, balance $H_2O$.

TEST PROCEDURE

The active oxygen concentration in solution is determined as a function of time for separate wash solutions containing compositions A and B, respectively, using the following procedure:

One liter of tap water is introduced into a two liter beaker and then heated to a constant temperature of 60° C. in a water bath. Ten grams of the particular composition being tested (A or B) are added to the beaker (time=0) with thorough mixing to form a uniform wash solution. After given periods of time (3, 7, 13, 20, 30, 40 and 50 minutes), a 50 ml aliquot is withdrawn from the wash solution and the total active oxygen concentration is determined by the procedure set forth below.

Determination of Total Active $O_2$ Concentration

The aforementioned 50 ml aliquot is poured into a 300 ml erlenmeyer flask containing 15 ml of a sulfuric/-molybdate mixture, the latter mixture having been prepared in large-scale amounts by dissolving 0.18 grams of ammonium molybdate in 750 ml of deionized water and then adding thereto 320 ml of $H_2SO_4$ (about 36N) with stirring. The solution in the erlenmeyer is thoroughly mixed and 5 ml of a 10% KI solution in deionized water is then added thereto. The erlenmeyer is sealed with a stopper, agitated and then allowed to stand in a dark place for about seven minutes. The solution in the flask is then titrated with a solution of 0.1N sodium thiosulfate in deionized water. The volume of thiosulfate required, in ml, is equal to the total active oxygen concentration, in millimole/liter, in the wash solution. The tests results for the two compositions tested are shown in Table 2 below.

TABLE 2

| Total Active Oxygen in Wash Solution (mmol/Liter) | | |
|---|---|---|
| Time (min.) | A (Silicate-free) | B (Silicate-containing) |
| 3 | 4.8 | 2.4 |
| 7 | 4.4 | 1.2 |
| 13 | 4.2 | 1.0 |
| 20 | 3.9 | 0.8 |
| 30 | 3.7 | 0.6 |
| 40 | 3.4 | 0.5 |

TABLE 2-continued

| Total Active Oxygen in Wash Solution (mmol/Liter) | | |
|---|---|---|
| Time (min.) | A (Silicate-free) | B (Silicate-containing) |
| 50 | 3.2 | 0.4 |

As shown in Table 2, the silicate-free composition A is significantly more stable and is characterized by a far slower loss of active oxygen from solution than the corresponding silicate-containing composition B.

What is claimed is:

1. A process for bleaching which comprises contacting the stained and/or soiled material to be bleached with an aqueous solution of a granular bleaching detergent composition comprising:

(a) a bleaching agent comprising a peroxyacid compound and/or a water-soluble salt thereof; and (b) at least one surface active agent selected from the group consisting of anionic, cationic, nonionic, ampholytic and zwitterionic detergents; said bleaching detergent composition being substantially free of silicate compounds.

2. The process of claim 1 wherein the bleaching agent comprises monoperoxyphthalic acid and/or a water-soluble salt thereof.

3. The process of claim 2 where the bleaching agent comprises magnesium monoperoxyphthalate.

4. The process of claim 1 wherein the bleaching agent also contains a peroxygen compound.

5. The process of claim 1 wherein said surface active agent comprises a linear alkyl benzene sulfonate.

6. The process of claim 1 wherein said composition also contains a sequestering agent.

7. The process of claim 6 wherein said sequestering agent comprises ethylene diamine tetraacetic acid.

8. The process of claim 1 wherein said composition also contains a detergent builder salt.

9. The process of claim 8 wherein said builder salt comprises pentasodium tripolyphosphate.

* * * * *